United States Patent [19]

Van Haaften

[11] 3,935,700

[45] Feb. 3, 1976

[54] SWITCHING MECHANISM FOR ELECTRONIC WATCH ELECTRO-OPTIC DISPLAY

[75] Inventor: Egbert Van Haaften, Closter, N.J.

[73] Assignee: Bulova Watch Company, Inc., New York, N.Y.

[22] Filed: Nov. 6, 1973

[21] Appl. No.: 413,370

[52] U.S. Cl. ..... 58/4 A; 58/58; 58/85.5

[51] Int. Cl.² ..... G04B 19/24; G04B 27/00

[58] Field of Search ..... 40/107; 58/4 A, 33, 50 R, 58/58

[56] References Cited

UNITED STATES PATENTS

| | | | |
|---|---|---|---|
| 3,643,418 | 2/1972 | Polinet et al. | 58/146 |
| 3,733,810 | 5/1973 | Girard | 58/4 A |
| 3,756,013 | 9/1973 | Bergey et al. | 58/23 R |

*Primary Examiner*—Edith Simmons Jackmon

[57] ABSTRACT

A selective switching mechanism for an electronic watch having a four digit electro-optic display, the mechanism having three operative positions. In the first switching position, the display is that of hours and minutes and requires for its full scale all four digits. In the second position, the display is that of seconds and requires for its full scale two of the four digits, and in the third position the display is calendar date and requires for its full scale two of the four digits. The switching mechanism is operated by a crown and stem assembly which occupies the first position when depressed part way, and which occupies the second position when fully depressed. The third position is occupied by pulling out the crown. Thus all three switching positions are attained by operation of a single actuating element.

6 Claims, 14 Drawing Figures

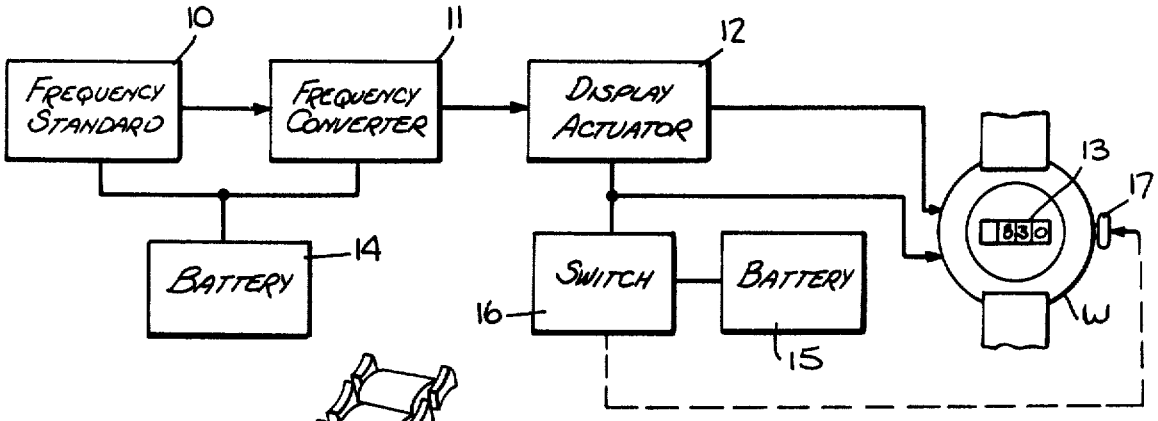
Fig. 1.
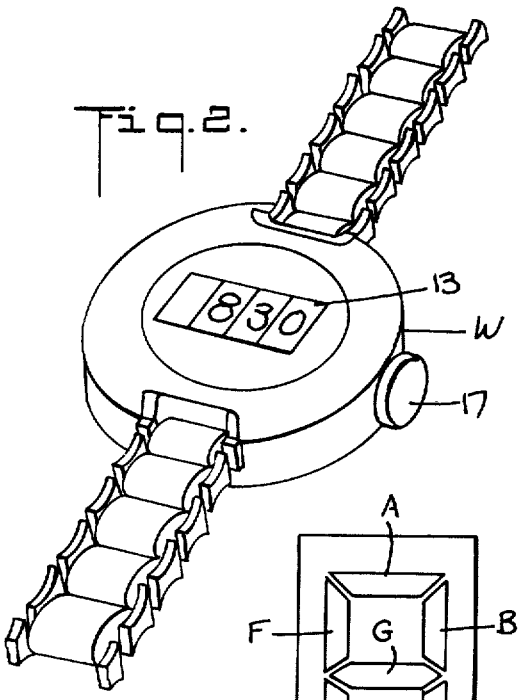
Fig. 2.
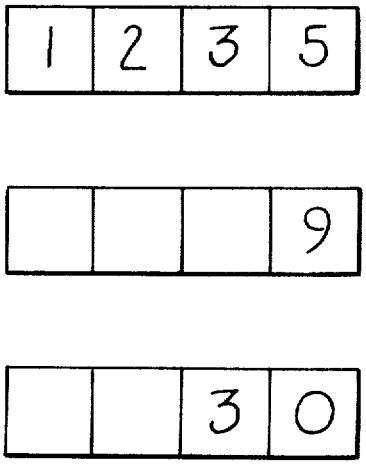
Fig. 4.
Fig. 5.
Fig. 6.
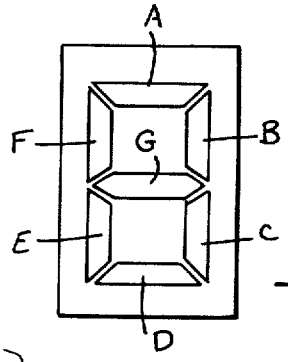
Fig. 3.
Fig. 7.
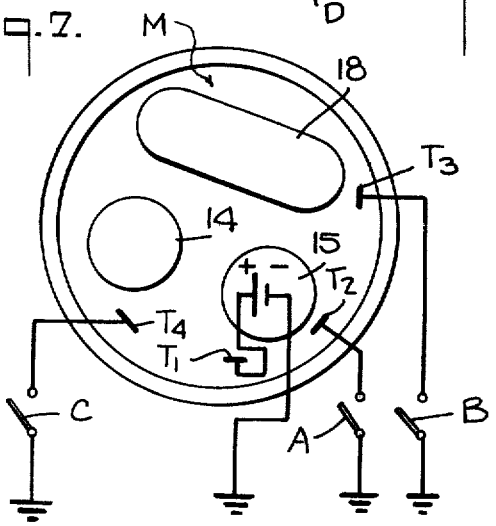
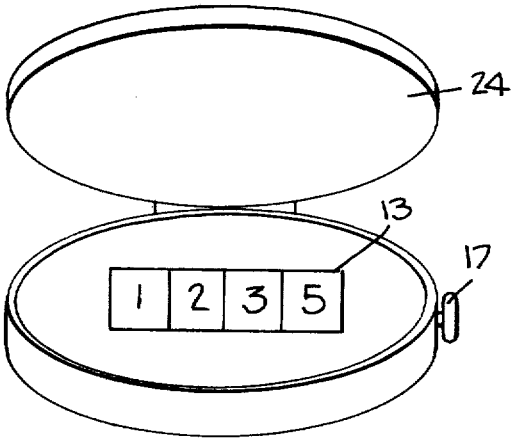
Fig. 10.

Fig. 10.
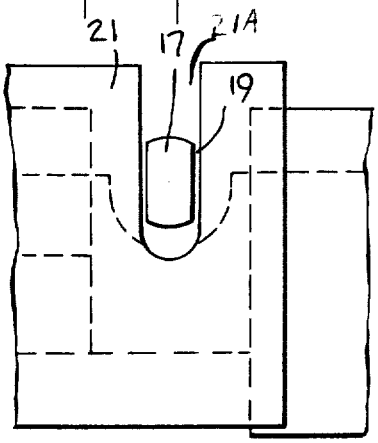
Fig. 11.
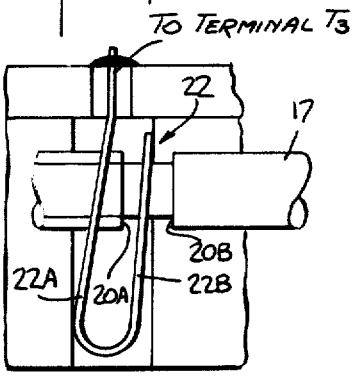
Fig. 12.
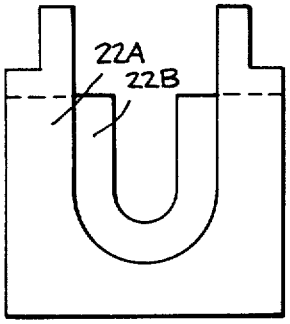
Fig. 9.
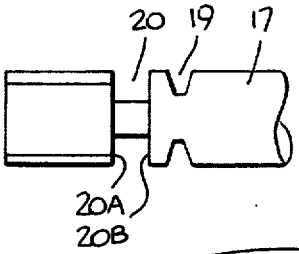
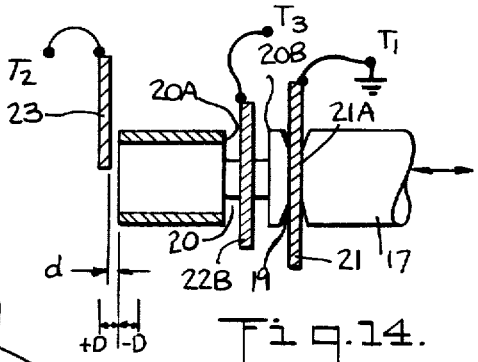
Fig. 14.
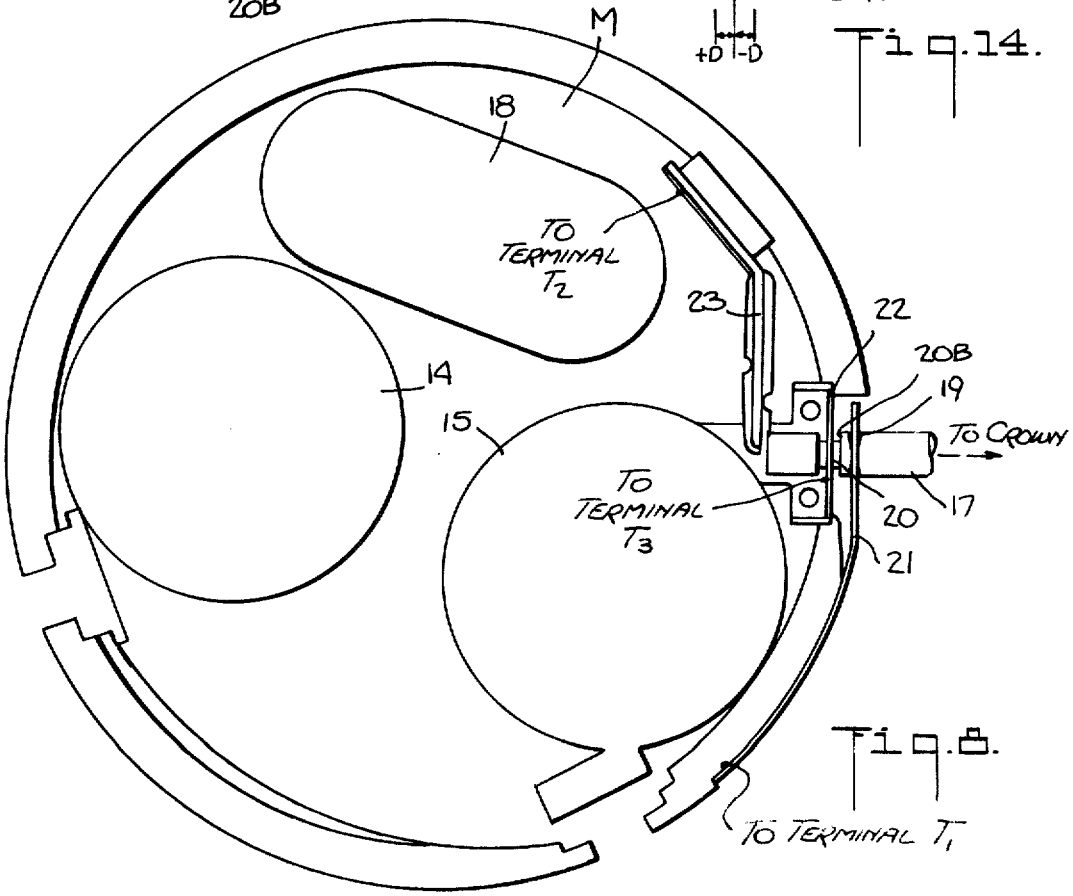
Fig. 8.

SWITCHING MECHANISM FOR ELECTRONIC WATCH ELECTRO-OPTIC DISPLAY

BACKGROUND OF THE INVENTION

This invention relates generally to electronic timepieces having an electro-optic digital time display, and more particularly to a switching mechanism for selectively activating a display to provide illuminated readings of hours and minutes, seconds or calendar date.

Battery-operated electronic timepieces are known which make use of a quartz-crystal high-frequency oscillator as a frequency standard, the frequency of the standard being divided down by a frequency converter to produce pulses for activating the elements of an electro-optic digital time display.

In U.S. Pat. Nos. 3,560,998, 3,576,099 and 3,664,118 among others, there is disclosed wrist watches of the type in which the optical display takes the form of light-emitting diodes (LED's) which present the hours, minutes and seconds of time in digital decimal form and which are energized, on demand, at the option of the wearer. Since the display is normally de-energized and invisible, this assures minimum power consumption and an increasingly long life for the watch battery. The electronic circuits employed in commercial versions of such timepieces are in integrated circuit form to provide a highly compact structure.

Modules are currently available which combine the integrated circuit of the electronic timepiece with an LED time display, thereby greatly simplifying manufacturing procedures, for all that is necessary to assemble a watch is to encase the module and to provide the necessary switch connections for activating and setting the LED display. In one such commercially available quartz-crystal digital watch module manufactured by the Microelectronic Products Division of the Hughes Aircraft Company, a four digit LED display is included to afford readings of hours and minutes, seconds or calendar date.

All four digits are required for an hours and minutes or time-of-day reading, such as 12:25, whereas since a seconds reading is in a scale from 1 to 60, only two of the digits are needed. And since the scale for the calendar date has a maximum of 31, this reading only requires two of the four digits.

In the Hughes module, as incorporated for example in the Elgin "Minicon" watch described in the instruction book published (9-15-73) by Elgin Watch Company of New York City, three exposed contact terminals are provided on the module, the terminals operating in conjunction with two push-button switches on the watch case to selectively activate the digital readout by means of a suitable logic circuit. We shall identify these switches as A and B. The first exposed contact terminals is the ground terminal and is connected to the case. When switch A is pressed in, it serves to connect the second terminal to the case and hence to the grounded terminal, the logic circuit arrangement being such that the time of day is then activated and displayed. When switch B is pressed, it serves to connect the third contact terminal to ground, the circuit arrangement being such that the display is then the calendar date. And when buttons A and B are pressed simultaneously, only the "seconds" is displayed.

There is also a fourth terminal acting in conjunction with a third switching button C which, when pressed, will cause whatever reading is being presented by operation of buttons A and B to advance rapidly, thereby to set the display. For example, if when button A is pressed, the display reads 12:25, then by also pressing the setting button C, the reading will advance in rapid steps to 12:26, 12:27 etc., the setting button being held in until the reading is at the desired setting, at which point button C is released. But since in the present invention, the setting mechanism is unchanged, no further consideration will be given to the fourth terminal and its associated switch button.

From the electrical and mechanical standpoint, there is nothing objectionable in a two-button switching system for selectively activating the digital read-out, but in terms of human engineeing, it has practical drawbacks. The wearer of the watch must not only manipulate two buttons, but he must also bear in mind which of the two buttons activates which display, and when it becomes necessary to press both buttons simultaneously. One cannot, as a practical matter, in a watch, label the two buttons, nor can one so distinctly locate these two buttons as to avoid improper action.

The same Hughes module may be incorporated in a pendant or pocket watch. In its traditional mechanical movement form, a pocket or pendant watch has a crown and stem arrangement for winding and setting purposes. The presence of switch buttons in an electronic version of a pendant or pocket watch is incongruous for it violates the traditional appearance of this watch form, and it is further objectionable for the reasons given above in connection with wrist watches.

SUMMARY OF THE INVENTION

In view of the foregoing, it is the main object of this invention to provide a switching mechanism for selectively activating the electro-optic display of an electronic watch to afford readings of the time-of-day, seconds and calendar date, the mechanism having a single, manually-operated actuating element.

More particularly, it is an object of this invention to provide a switching mechanism of the above-type whose actuating element is constituted by a crown and stem assembly which can be depressed and pulled out to effect the desired switching operations.

A significant advantage of the invention is that the single actuating element is adapted to carry out the switching actions heretofore effected by two distinct switches, thereby centralizing and simplifying the selective operation of the time display.

Another advantage of the invention is that by incorporating a crown and stem assembly in an electronic watch, the watch has a traditional appearance which is of particular value in the context of pocket watches of the hunting type having a lid which is opened when the crown is pushed in to display the time of day.

Also an object of the invention is to provide a switching mechanism for an electronic watch module having a four digit light-emitting diode display, the switching mechanism having a single actuating element which takes the form of a crown and stem assembly whereby the module lends itself to rapid assembly in a conventional watch casing adapted to accommodate such an assembly.

Briefly stated, these objects are attained in a module for an electronic watch having a four digit electro-optic display and a switching mechanism coupled to the display to selectively activate same, the mechanism being operated by a crown and stem assembly which when depressed part way occupies a first switching position in which all four digits are operative to afford a time-of-day reading, and when depressed fully, occupies a second position in which two of the digits are operative to afford a "seconds" reading, a third switching position being occupied when the crown is pulled out to afford a two digit reading of calendar date.

While the invention will be described herein in connection with an electro-optic display of the LED type, it will be appreciated that it is also applicable to other forms of such displays, such as liquid crystal and electro-chromic displays.

OUTLINE OF THE DRAWING

For a better understanding of the invention as well as other objects and further features thereof, reference is made to the following detailed description to be read in conjunction with the accompanying drawing wherein:

FIG. 1 is a block diagram of an electronic watch having a switch-actuated electro-optic display in accordance with the invention, FIG. 2 is a perspective view of the electronic watch in a casing, FIG. 3 shows a light-emitting diode number-forming matrix, FIG. 4 illustrates a four digit time-of-day display, FIG. 5 illustrates a one digit "seconds" display, FIG. 6 illustrates a two digit calendar date display, FIG. 7 schematically illustrates a standard module for the electronic watch, FIG. 8 shows the standard module as modified to include a crown and stem switching mechanism in accordance with the invention, FIG. 9 is a separate view of the stem, FIG. 10 shows the relationship between the grounding strap and the stem of the crown and stem assembly, FIG. 11 is a side view of the spring contact which cooperates with the stem, FIG. 12 is a front view of the spring contact, FIG. 13 is a perspective view of a hunting watch incorporating the invention, and FIG. 14 is a schematic illustrating the switching operations.

DESCRIPTION OF THE INVENTION

Referring now to FIG. 1, there is shown in simplified block diagram, the main components of an electronic watch in accordance with the invention. The watch comprises a time base or frequency standard 10 in the form of a quartz-crystal, high-frequency oscillator whose output is supplied to a converter 11 in the form of a multi-stage divider that divides down the frequency from standard 10 so that the output signal of the converter is at a suitable low timing rate, such as a pulse frequency of 1 Hz. This signal is applied to a display actuator 12 constituted by a suitable logic circuit which controls a four digit time display, generally indicated by numeral 13, making use of light-emitting diodes (LED's).

Frequency standard 10 and frequency converter 11 are both energized by a first replaceable battery 14. The display actuator 12 and the LED time display are energized by a second replaceable battery 15 under the control of a switching mechanism 16 operated by the crown and stem assembly 17 of the watch so that power from battery is not drawn and the electro-optic display is inactive save when switch 16 is actuated in a particular manner. All of these components including the time display are incorporated in a single module to be later described, which is placed in a wrist watch casing W as shown in FIG. 2, with the digital display exposed through a window on the face of the watch.

In normal operation, time is continuously being kept but is not presented by LED display 13. That is to say, no time indication is visible, this being the normal condition which prevails in order to conserve the power of battery 15. However, even though the time is not displayed, the electronic watch system continues to keep accurate time and is capable of displaying the time or calendar date at any instant when the crown and stem assembly is manually actuated.

Each of the four LED digits may be defined by a selectively-activated dot matrix. Alternatively, this display may be formed by a seven bar segment, such as that shown in FIG. 3, composed of seven, light-emitting diodes A to G of elongated shape, so arranged that by energizing an appropriate combination of bars, any one of the numbers 0 through 9 may be presented. The invention is not limited to any one form of electro-optic display.

The display has three distinct states: the first being the time-of-day, given in hours and minutes; the second being seconds; and the third being calendar date. These states are under the control of crown and stem assembly 17 which operates the switching mechanism 16 whereby when the crown is depressed part way, the time-of-day is displayed, when it is fully depressed, seconds are displayed, and when the crown is pulled out, the calendar date is presented. Since the display is electronically actuated at the rate of one timing pulse per second, these pulses may be electronically counted and accumulated to afford a reading of seconds and a reading of minutes and hours. After every 24 hour interval is counted, the calendar date is advanced. The nature of the decoder or logic circuits and all other electronic components is disclosed in the aboveidentified patents and in U.S. Pat. Nos. 3,756,011 and 3,756,013.

Thus as shown in FIG. 4, when the crown of assembly 17 is pressed in part way, a time-of-day reading (12:35) is presented whose full scale requires all four digits of the display. When the crown is fully pushed in, a "seconds" reading 9 as shown in FIG. 5, is given, and since there are 60 seconds in this scale, no more than the last two digits of the display are required. And when the crown is pulled out, a calendar date reading 30 is obtained, as shown in FIG. 6. Since the calendar date reading is in a scale from 1 to 31, only the last two digits are used therefor.

We shall now consider, in connection with FIG. 7, a standard electronic watch module M that incorporates all of the circuit elements shown in FIG. 1, including batteries 14 and 15. The digital time display is on the opposite face of the module and does not therefore appear in FIG. 7. The various circuits of the frequency standard, the divider and the display actuator are in integrated circuit form represented by microelectronic block 18.

Module M is provided with four exposed contact terminals $T_1$, $T_2$, $T_3$ and $T_4$. Terminal $T_1$ is connected to ground which is the case W for the watch. Terminal $T_2$ is connected to ground by way of switch A, terminal $T_3$ is connected to ground by way of switch B and terminal $T_4$ is connected to ground by way of switch C. These switches in a standard watch are operated by push buttons mounted on the case. Terminal $T_1$ makes contact with the positive side of battery 15 whose negative side rests on a battery strap that makes contact with the back of the case for the module. Hence, terminal $T_1$ is grounded through battery 15, not directly.

The relationship of these contact terminals to the logic of the display actuator 12, the LED display 17 and battery 15 is such that when switch A is closed, this action activates all four digits to give a time-of-day indication. When, however, switch B is closed simultaneously with switch A, then the "seconds" is presented in the last two digits of the display. But if switch B is closed while switch A is open, then the calendar date is displayed in the last two digits.

To set any one of the three digital read-outs, switch A or B or both A and B are closed to select the read-out to be set, and then switch C is closed to cause the selected read-out to advance in rapid succession.

Hence with the standard module arrangement, three switch buttons are entailed. In the present invention, switch C is retained, but the actions of switches A and B are coordinated into a single switching mechanism operated by crown and stem assembly 17. Setting switch C is used infrequently and preferably takes the form of a button that can only be pressed in by a sharp instrument, such as a pencil or paper clip.

Referring now to FIG. 8, the standard module is shown in its modified form in accordance with the invention, the module including crown and stem assembly 17, of which only the stem is shown. As illustrated separately in FIG. 9, stem 17 is provided with a narrow, annular groove 19 having a trapezoidal cross section, and a broader annular groove 20 having a rectangular cross section to define a front shoulder 20A and a rear shoulder 20B.

Stem 17 is maintained in its neutral position by means of a resilient grounding strap 21 having a slot 21A which accommodates groove 19 in the stem, as shown in FIG. 10. This strap, which follows the peripheral curvature of the module, is connected to ground terminal $T_1$ and provides a permanent connection between this terminal and stem 17. Hence stem 17 is permanently connected to ground. When the stem is depressed or pulled out by means of the crown, the strap is flexed and when the stem is released, the strap returns it to its neutral position.

A U-shaped flat spring contact 22 is provided which is connected to contact terminal $T_3$ on the module. The front and rear sections 22A and 22B of contact 22 straddle stem 17, the front section 22A having a central slot therein which clears stem 17. The rear section 22B also has a central slot therein, which rear section in the neutral position of stem 17 lies about midway between the front and rear shoulders 20A and 20B of groove 20 and therefore makes no contact with the stem.

Also provided is a flat resilient contact 23 having a V-formation which is connected to contact terminal $T_2$, the end portion of contact 23 being spaced a distance *d* from the free end of stem 17 when stem 17 is in its neutral position.

When as shown in FIG. 14, stem 17 is pushed in part way to transverse the distance *d*, the free end thereof engages resilient contact 23, thereby connecting terminal $T_2$ to ground and providing a time-of-day display. Pushing in stem 17 still further to its fully depressed position to transverse the distance +D causes the rear shoulder 20B of stem 17 to engage the rear section 22B of spring contact 22, thereby connecting terminal $T_3$ to ground, terminal $T_2$ still being connected to ground through contact 23. Consequently, since both terminals $T_2$ and $T_3$ are simultaneously grounded, a "seconds" read-out is presented.

When stem 17 is pulled out from neutral to traverse the distance −D, then spring contact rear section 22B engages and makes connection with the front shoulder 20A of the stem, the stem being disengaged from contact 23. Thus in this position, only terminal $T_3$ is grounded and the calendar date is presented.

To recapitulate the action of stem 17, when the stem is pressed in part way, only contact 23 is engaged to connect terminal $T_2$ to ground, thereby activating the time-of-day display. A further inward movement of stem 17 acts to effect engagement with spring contact 22 without breaking contact with terminal $T_2$ whereby terminal $T_3$ as well as terminal $T_2$ is grounded to produce a "seconds" read-out. Finally, when the stem is pulled out, only contact 22 (terminal $T_3$) is grounded to afford a calendar date read-out. When the stem is released, it returns to its neutral position and the display is de-energized.

In a hunting type pocket watch, as shown in FIG. 13, a spring-biased lid 24 is provided, the lid being normally held shut by a suitable latching mechanism (not shown) which is released when the stem is depressed, the stem having a tab or other means to operate the latching mechanism. Consequently, when the hunting-type watch is to be consulted and the crown is pressed to push in the stem, the lid flips open to reveal the illuminated display. Thus the watch has the traditional appearance of an old fashioned hunting watch but when the lid is opened, a modern, illuminated digital display is presented rather than the conventional pointers.

While there has been shown and described a preferred embodiment of the invention it will be appreciated that many changes may be made therein without, however, departing from the essential spirit thereof. For example, the same crown and stem switching assembly may be used to carry out A, A + B, or B switching actions with other electro-optic display configurations in which, for example, the hours and minutes and the seconds are presented by a set of four digits and the calendar date by a separate set of two digits.

I claim:

1. A battery-operated electronic watch formed by a self-contained cased module having three exposed terminals and having an electro-optic digital time display, the first terminal being connected through said battery to said case which represents ground, said time display having a first time-of-day display state which is presented when the second terminal is grounded, a second state presenting seconds when the second and third terminals are grounded, and a third calendar date state when the third terminal is grounded, and a switching mechanism for selectively enabling any one of the three states, said switch mechanism comprising:

A. a crown and stem assembly which is supported for axial movement, said stem having a narrow annular groove and a broad annular groove axially spaced from the narrow groove and disposed adjacent the free end of the stem, B. a resilient strap connected at one end to ground, the other end of said strap having a notch therein which accommodates said narrow groove whereby said strap maintains said stem in a neutral position and connects said stem permanently to ground, C. a flat spring contact extending into the broad groove and spaced from the rear and front shoulders formed on either side of the broad groove when the stem is in its neutral position, the flat spring contact being connected to the third terminal, and D. a flat resilient element connected to the second terminal, the end portion thereof being spaced from the free end of the stem in the neutral position whereby when the stem is pushed in part way, its free end engages the end portion of the element to effect a connection only to said second terminal thereby grounding only said second terminal, when it is pushed in fully, the rear shoulder of said broad groove also engages the falt spring contact to effect a simultaneous engagement with the third terminal thereby simultaneously grounding said third terminal, and when it is pulled out, the front shoulder of said broad groove engages the flat spring contact to effect a connection only with the third terminal thereby grounding only said third terminal.

2. An electronic watch as set forth in claim 1, wherein said electro-optic display is formed by light-emitting diodes.

3. An electronic watch as set forth in claim 1, wherein said electro-optic display is formed by liquid crystal devices.

4. An electronic watch as set forth in claim 2, wherein each digit is formed by a matrix of seven light-emitting diodes for segments.

5. An electronic watch as set forth in claim 1, wherein said timing pulses are derived from a high-frequency time base through a frequency converter.

6. An electronic watch as set forth in claim 1, wherein said time base is a crystal-controlled oscillator.

* * * * *

UNITED STATES PATENT OFFICE

CERTIFICATE OF CORRECTION

PATENT NO. : 3,935,700

DATED : February 3, 1976

INVENTOR(S) : Egbert Van Haaften

It is certified that error appears in the above-identified patent and that said Letters Patent are hereby corrected as shown below:

Column 2, line 15 "engineeing" should have read -- engineering --

Column 3, line 66 "battery is" should have read -- battery 15 is --

Column 5, line 61 "transverse" should have read -- traverse --

Column 5, line 65 "transverse" should have read -- traverse --

Column 7, line 15 "falt" should have read -- flat --

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*